US005868614A

United States Patent [19]

Hirano

[11] Patent Number: 5,868,614

[45] Date of Patent: Feb. 9, 1999

[54] COIN DISPENSER

[75] Inventor: Yasuo Hirano, Tokyo, Japan

[73] Assignee: Universal Sales Co., Ltd., Tokyo, Japan

[21] Appl. No.: 764,181

[22] Filed: Dec. 13, 1996

[30] Foreign Application Priority Data

Dec. 19, 1995 [JP] Japan ..... 7-33004

[51] Int. Cl.[6] ..... G07D 1/00

[52] U.S. Cl. ..... 453/57

[58] Field of Search ..... 453/13, 33, 34, 453/35, 49, 57

[56] References Cited

FOREIGN PATENT DOCUMENTS

| | | | |
|---|---|---|---|
| 485 709 | 5/1992 | European Pat. Off. | 453/57 |
| 5-22276 | 3/1993 | Japan . | |
| 7-114658 | 5/1995 | Japan . | |

*Primary Examiner*—F. J. Bartuska
*Attorney, Agent, or Firm*—Rohm & Monsanto, PLC

[57] ABSTRACT

A simplified coin dispenser for a gaming machine prevents jamming of coins when paying them out. The coin dispenser is provided with a bucket for accommodating a plurality of coins used as game media in the gaming machine. A rotary disk and an associated rotary drive for rotating same are provided at the bottom of the bucket. The rotary disk has a plurality of circular openings that are disposed side-by-side along the circumference thereof, each of the circular openings being circular in shape and dimensioned to permit a coin to enter therein. A coin-feeding guide plate and a coin receiving plate are disposed under the rotary disk so as to be rotated in unison with the rotary disk. Coins that have entered the circular openings are received at the coin receiving plate and are guided by the coin-feeding guide plate in a direction radially away from the center of the rotary disk. The coins then are energetically ejected from a coin outlet. The coin receiving plate has inclined portions formed integrally therewith for inclining the coins that have entered the circular openings of the rotary disk and for moving them away from the center of the rotary disk. Also, a gap having a thickness that corresponds to the thickness of a coin is maintained between the rotary disk and the coin receiving plate.

3 Claims, 10 Drawing Sheets

44
44
44
45
46
46
24
46
49
45
45
50
50
41
40
50
41
41
39
51
38
39
51
39
51
39
52
37
37d
37b
37c
37a
36
56
36a
36d
36e
36c
54
36b
43
M
42
22
61
60
62
26
26a
26b
63
CONTROLLER
DRIVER
64

COIN DISPENSER

BACKGROUND OF THE INVENTION

1. Field of the Invention

This invention relates generally to coin dispensers of the type employed in gaming machines, such as slot machines that use coins and/or game media, such as medals, tokens and the like.

2. Description of the Related Art

Conventionally, a coin dispenser for a gaming machine is provided with a bucket for accommodating a large number of coins therein, a coin feeding portion for feeding the coins with respective identical surfaces turned up, one-by-one from the bucket, and a base that supports the bucket and the coin feeding portion.

FIG. 11 is a partially fragmented plan representation of a prior art hopper apparatus having a body 1, disclosed in Japanese Laid-Open Number 7-114658 as a conventional coin dispenser. A rotary disk 3 is rotatably provided on the surface of a support plate 2 mounted on a base (not shown). Rotary disk 3 is driven into rotation by an electric motor (not shown). The rotary disk is made of synthetic resin, and is formed, in this implementation, with about five to ten circular openings 4 arranged at predetermined intervals along the circumference of rotary disk 3. Each of the circular openings is slightly larger than the diameter of a coin C.

The underside of rotary disk 3 is provided with a coin-feeding guide plate 5 secured thereto so as to rotate synchronously therewith. The coin-feeding guide plate is formed in the shape of a ratchet wheel, and is provided with guide pawls 5*a*. The number of guide pawls is the same as the number of circular openings 4 in rotary disk 3. As shown in FIG. 11, coins C enter circular openings 4 and are supported on support plate 2. Then, the coins are held by guide pawls 5*a* and are urged in the direction away from the center of rotary disk 3, synchronously with the rotation of rotary disk 3.

Rotary disk 3 is installed on support plate 2 with the use of a jig (not shown), or the like. During installation, it is necessary to maintain a gap between rotary disk 3 and support plate 2 so as to be able to eject the coins one-by-one.

On support plate 2, there is installed an outer guide plate 6 that is slightly thicker than coin C. The plates are covered with a cover (not shown). Outer guide plate 6 is formed of a rectangular metallic plate, and is provided with a circular opening 7 at the center thereof. Opening 7 has a diameter that is smaller than that of rotary disk 3 and larger than the outer diameter of coin-feeding guide plate 5 at guide pawl 5*a*. A circumference of opening 7 is formed as a coin guide plane 8.

Further with respect to FIG. 11, at the left side of outer guide plate 6 on support plate 2, a coin outlet 9 is formed having a width such that the coins can pass therethrough one-by-one. A fixed roller 10 and a displaceable roller 11 are disposed at both sides of coin outlet 9. Coin outlet 9 and rollers 10 and 11 are arranged as a coin ejecting portion for ejecting the coins that have come to a position facing coin outlet 9.

At a position heading for coin outlet 9 in circular opening 7, a guide projection 12 is provided and arranged to project out of a corresponding support hole (not specifically designated) in support plate 2, for supporting a ball (sphere) that is urged by a spring (not shown) so as to adjoin the underside of rotary disk 3. In operation, guide projection 12 catches a coin C that comes to the position facing coin outlet 9 with the ball, and then guides the coin toward coin outlet 9.

When assembling the coin dispenser described above, the gap between rotary disk 3 and support plate 2 is adjusted with a jig or the like as it is important to avoid irregularity or non-uniformity of the gap. Rotary disk 3 is made of flexible material such as synthetic resin to increase the ability to manufacture the coin dispensers in production quantities and reduce the cost of manufacture. When there is a large number of coins on rotary disk 3 and the load on the disk is correspondingly increased, rotary disk 3 becomes distorted and the dimension of the gap is caused to change. Thus, the coins may become lodged under rotary disk 3, particularly between coin-feeding guide plate 5 and support plate 2, whereupon the arrangement easily becomes jammed.

In addition, when two coins enter opening 7 in a stacked condition, or when a coin has not moved toward coin guide plane 8 for some cause even though rotary disk 3 rotates, the coin will not go toward coin outlet 9, and may pass by the position facing coin outlet 9 in continued motion with rotary disk 3. That is, the coin is not ejected from the dispenser. Therefore, in order to prevent such difficulties, guide projection 12 is provided for catching any coin that has come to the position facing coin outlet 9, and directs the coin toward coin outlet 9 as previously mentioned. This correction to the problems with the known arrangement, however, requires additional parts such as a ball, a spring, etc., and accordingly the known coin dispenser becomes complicated, expensive, and unreliable.

SUMMARY OF THE INVENTION

It is, therefore, an object of the present invention to provide a coin dispenser for a gaming machine wherein jamming of the coins when paying them out, and other similar problems, are prevented.

It is also an object of this invention to produce a reliable arrangement for dispensing coins that is simpler than the known arrangements.

In accordance with the invention, a coin dispenser is provided with a bucket for accommodating a plurality of coins, that function as game media in the gaming machine. A rotary disk is provided at the bottom of the bucket, and drive means drive the rotary disk into rotation. A plurality of circular openings are disposed side-by-side along a circumference of the rotary disk, each of the circular openings being dimensioned to permit the coins in the bucket to enter therein. A coin receiving plate receives the coins that have entered the circular openings from the bucket. A coin-feeding guide plate is disposed beneath the rotary disk and arranged to rotate synchronously therewith. The coin feeding guide plate guides the coins received at the coin receiving plate radially away from a center of the rotary disk, in response to the rotation thereof. Coin ejection means ejects the coins guided by the coin-feeding guide plate. The coin receiving plate has inclined portions for inclining the coins that entered the circular openings of the rotary disk and moving them in the direction away from the center of the rotary disk. Also, the coin receiving plate is disposed so as to rotate synchronously with the rotary disk and the coin-feeding guide plate thereunder, with a gap being produced by holding the coin-feeding guide plate between the rotary disk and the coin receiving plate.

When the rotary disk is rotated, the coin receiving plate is rotated synchronously therewith. During such rotation, the coins in the bucket enter the circular openings and are captured by the coin receiving plate. They are then moved in the direction of rotation of the rotary disk by the coin-feeding guide plate rotating together with the rotary disk, and are urged substantially radially away from the center of the rotary disk. Since the coins are made to be inclined in the direction away from the center of the rotary disk by the inclined portions of the coin receiving plate, when the coins have come to the position at the coin ejection means or in the vicinity thereof, the coins depart from the rotary disk and are ejected by the coin ejection means.

Thus, the coin receiving plate rotates together with the rotary disk, the coins in the circular openings being inclined, with a gap (e.g., that is substantially equal to the thickness of a coin) at the underside of the rotary disk being maintained by the coin-feeding guide plate. Then, the coin receiving plate moves the inclined coins in the direction away from the rotary disk at the position of the coin ejection means or in the vicinity thereof without fail. Therefore, the coins that entered the circular openings of the rotary disk are smoothly ejected without being caught or becoming jammed under the rotary disk.

In addition, it is not necessary to provide means such as the guide projection for catching the coin that has come to the position facing the coin outlet and directing the coin toward the coin outlet, as described in the above-mentioned conventional coin dispenser. Thus, the arrangement of the coin dispenser of the present invention is simpler and more reliable.

In one embodiment of the invention, the coin receiving plate is provided with a plurality of notches, the number of which is the same as the number of circular openings, and are arranged along a circumference of the coin receiving plate. Each of the notches, in a specific illustrative embodiment of the invention, is formed to have an arcuate shape and to have a diameter that is slightly larger than that of each of the circular openings of the rotary disk. In a specific illustrative embodiment of the invention, the inclined portions are formed by bending a portion inside of each of the notches upward at a predetermined angle with respect to the surface of the coin receiving plate. In this manner, the coins that enter the circular openings of the rotary disk are to be inclined at the inclined portions to be moved in the direction away from the center of the rotary disk.

BRIEF DESCRIPTION OF THE DRAWING

The foregoing and other objects, features, and advantages of the invention will become more apparent from the following detailed description taken in conjunction with the accompanying drawings, in which:

FIG. 8 (B) is a partially cross-sectional side representation of a portion of the coin receiving plate of FIG. 8 (A) taken at line (B);

DETAILED DESCRIPTION

Figure 1:
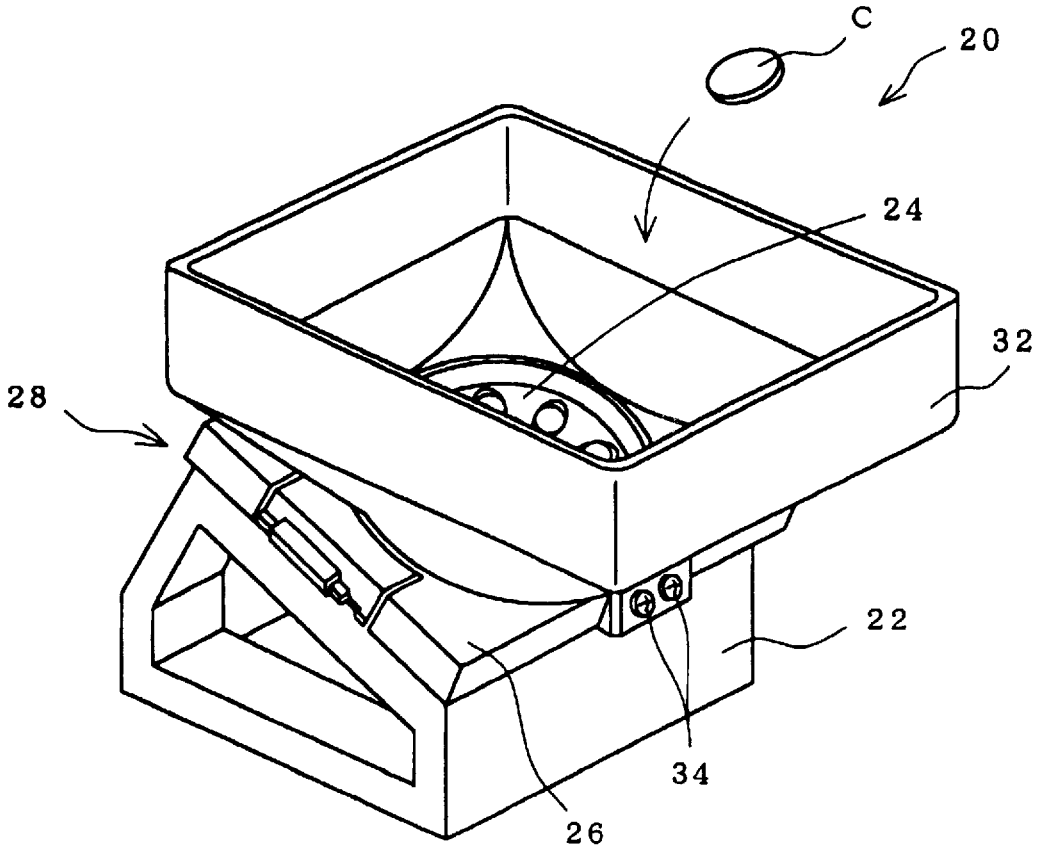
FIG. 1 is an isometric representation of a coin dispenser in accordance with a specific illustrative embodiment of the invention.

FIG. 1 is an isometric representation of a coin dispenser 20 constructed in accordance with a specific illustrative embodiment of the invention. Coin dispenser 20 is provided with a body 28 that includes a base 22, a rotary disk 24, and a cover 26 therein, and a bucket 32 installed on cover 26 for accommodating a large number of coins C therein. Bucket 32 is engageably and disengageably mounted with screws 34 on cover 26 of body 28.

Figure 2:
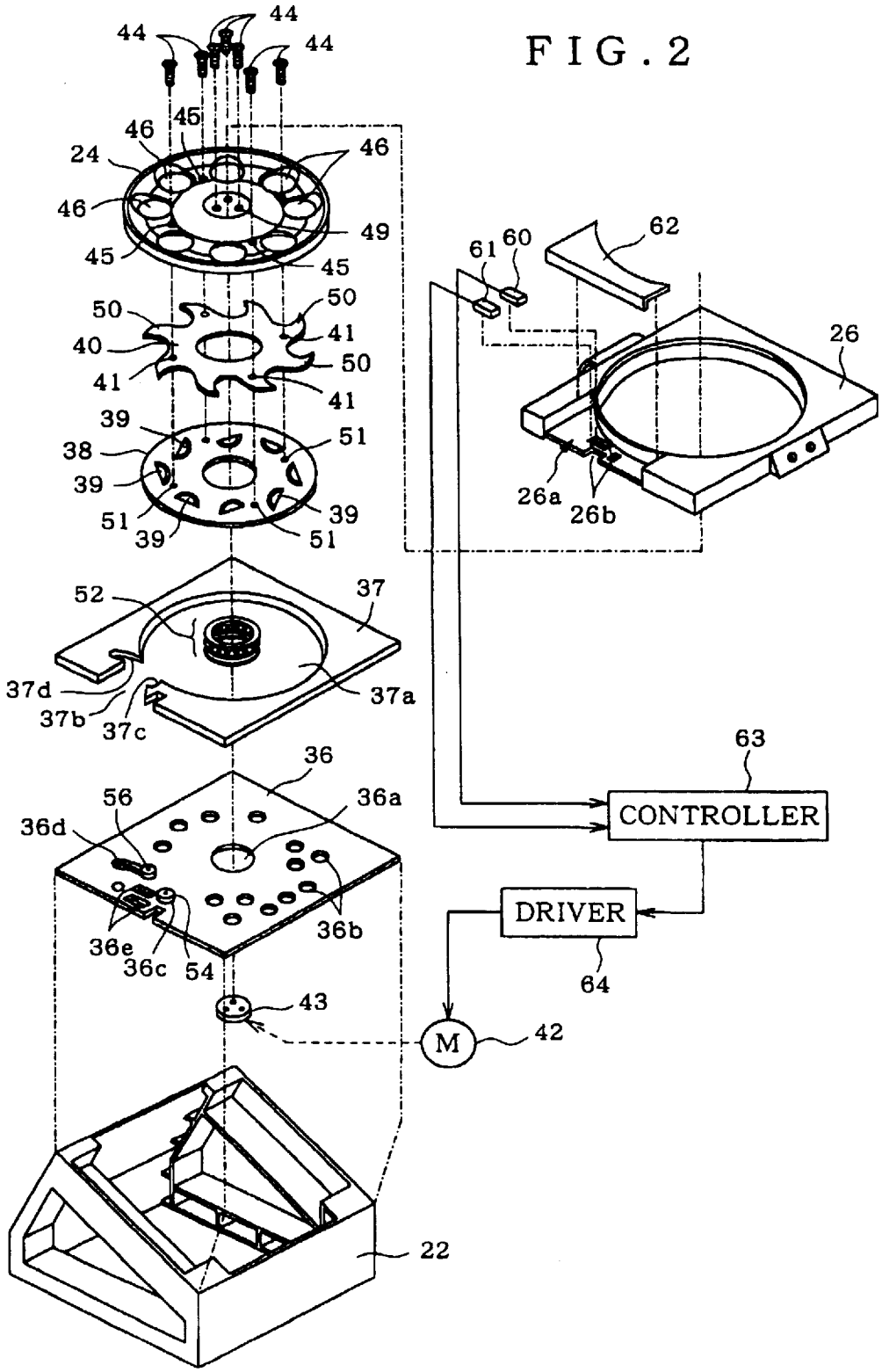
FIG. 2 is an exploded isometric representation of a portion of an arrangement of the coin dispenser of FIG. 1.

FIG. 2 is an exploded isometric representation of body 28 of coin dispenser 20 of FIG. 1, wherein bucket 32 is removed therefrom. Base 22 consists of a frame wherein the top thereof is formed so as to be slanted at an appropriate angle (e.g., twenty-five degrees). On the top thereof, a baseplate 36 which consists of a metallic plate of a rectangular shape is installed aslant thereon.

On the surface of baseplate 36, an outer guide plate 37 is installed. Outer guide plate 37 consists of a metallic plate of a rectangular shape and having a thickness dimension that is slightly larger than that of a coin C (not shown in this figure). Base 22, baseplate 36, and outer guide plate 37 are covered with cover 26. Outer guide plate 37 is provided with a circular opening 37*a* in the center thereof having a diameter that is smaller than that of rotary disk 24, larger than a coin receiving plate 38, and also larger than the outer diameter of a coin-feeding guide plate 40 (i.e., to the radially outer extent of a guide pawl 50). The circumference of opening 37*a* is formed as a coin guide plane.

A coin outlet 37*b* having a width that is predetermined to permit coins (not shown in this figure) to pass therethrough one-by-one is provided at the left side of outer guide plate 37. At an inlet end of coin outlet 37*b*, notches 37*c* and 37*d* are provided for accommodating a fixed roller 54 and a displaceable roller 56 that will be discussed in detail hereinbelow.

Figure 8A:
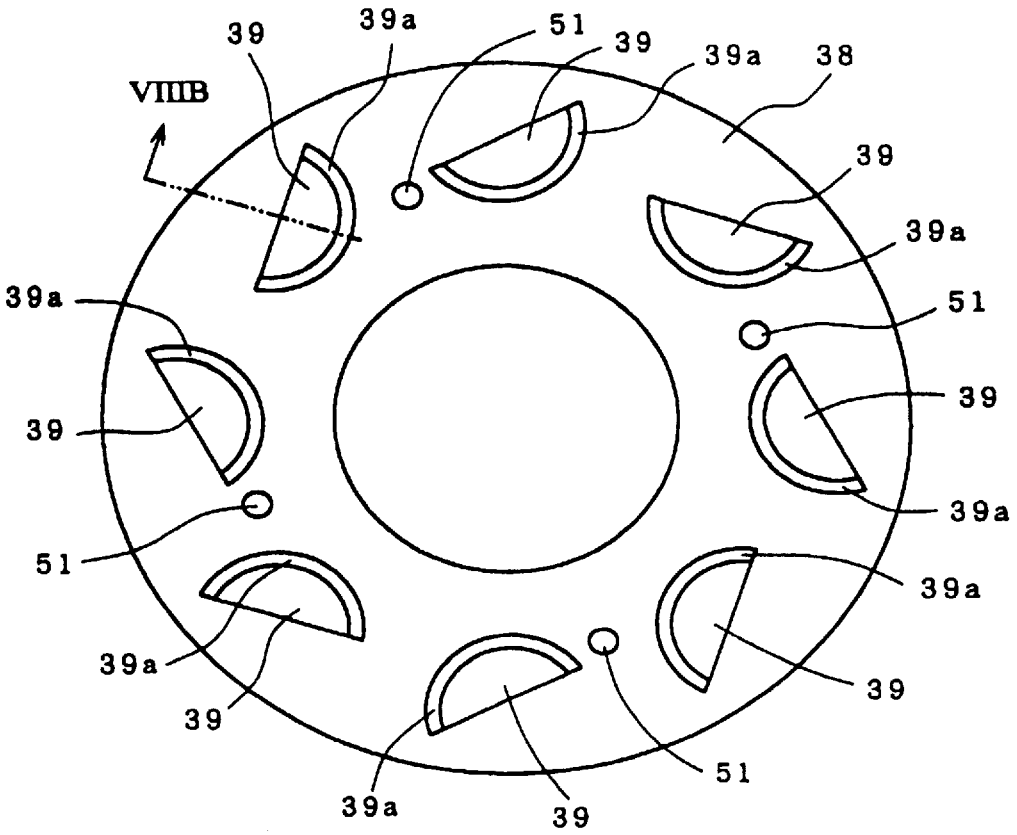
FIG. 8 (A) is a top plan representation of a coin receiving plate of the coin dispenser.
Figure 8B:
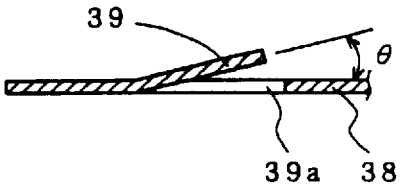

Beneath rotary disk 24, i.e., at the underside thereof, a circular coin receiving plate 38 is disposed for receiving the coins (not shown in this figure) that have entered circular openings 46 of rotary disk 24 from bucket 32 (not shown in this figure). Coin receiving plate 38 rotates synchronously with rotary disk 24 via a coin-feeding guide plate 40 having a ratchet wheel configuration and disposed between coin receiving plate 38 and rotary disk 24, as will be described in greater detail hereinafter. On the surface of coin receiving plate 38, and as shown in FIGS. 8(A) and 8(B), a plurality (eight, in the embodiment) of inclined portions 39 are arranged at predetermined angular intervals (e.g., forty-five degrees, in the embodiment), along the circumference. Each of inclined portions 39 is formed by bending a portion that is notched and bent upward at a predetermined angular θ (e.g., fifteen degrees), as shown in FIG. 8(B).

Coin-feeding guide plate 40, which is interposed between coin receiving plate 38 and rotary disk 24 positioned above, rotates synchronously therewith. The coin-feeding guide plate is provided with a plurality of pawls 50 along the circumference thereof, and functions to hold the coins (not shown in this figure) that are received by coin receiving plate 38, at angular intervals defined by adjacent ones of pawls 50. When rotary disk 24 rotates, the coins are urged radially away from the center thereof.

Coin receiving plate 38 and coin-feeding guide plate 40 are secured to the lower side of rotary disk 24 by screws 44 that are, in this specific illustrative embodiment of the invention, installed from above rotary disk 24.

Beneath baseplate 36, an electric motor 42 (shown schematically) having a deceleration mechanism (not specifically identified) is disposed. A head 43 is secured at an output shaft of the deceleration mechanism, which is positioned within shaft hole 36*a* of baseplate 36. Head 43 is secured to rotary disk 24 by screws 44' that, in this specific illustrative embodiment of the invention, are installed from above rotary disk 24. Thus, rotary disk 24, coin-feeding guide plate 40, and coin receiving plate 38 form a unitary assembly and are driven into rotation as a unit via head 43 by means of the deceleration mechanisms (not shown) with electric motor 42 providing the motive power.

On baseplate 36, besides shaft hole 36*a*, there are provided a plurality of holes 36*b* for ejecting dust, a shaft hole 36*c* for fixed roller 54 and an elongated slot 36*d* for accommodating displaceable roller 56 at both sides of coin outlet 37*b* on baseplate 36, and a pair of detection windows 36*e* for respective ones of coin sensors 60 and 61 that detect the coins that are ejected and provide corresponding signals to a controller 63, as will be described hereinafter.

Figure 3:
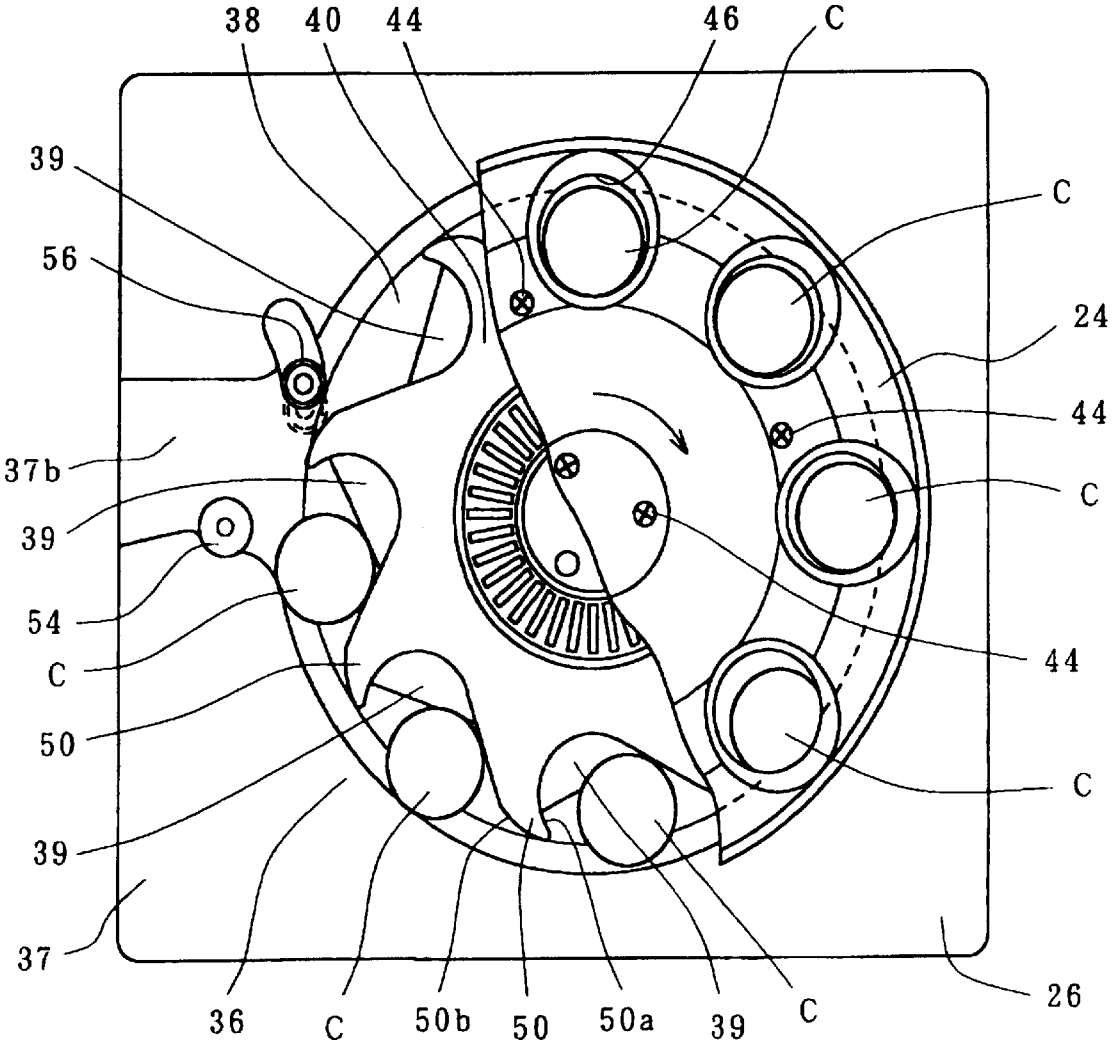
FIG. 3 is a top plan representation of the coin dispenser of FIG. 2, partially broken away.
Figure 4:
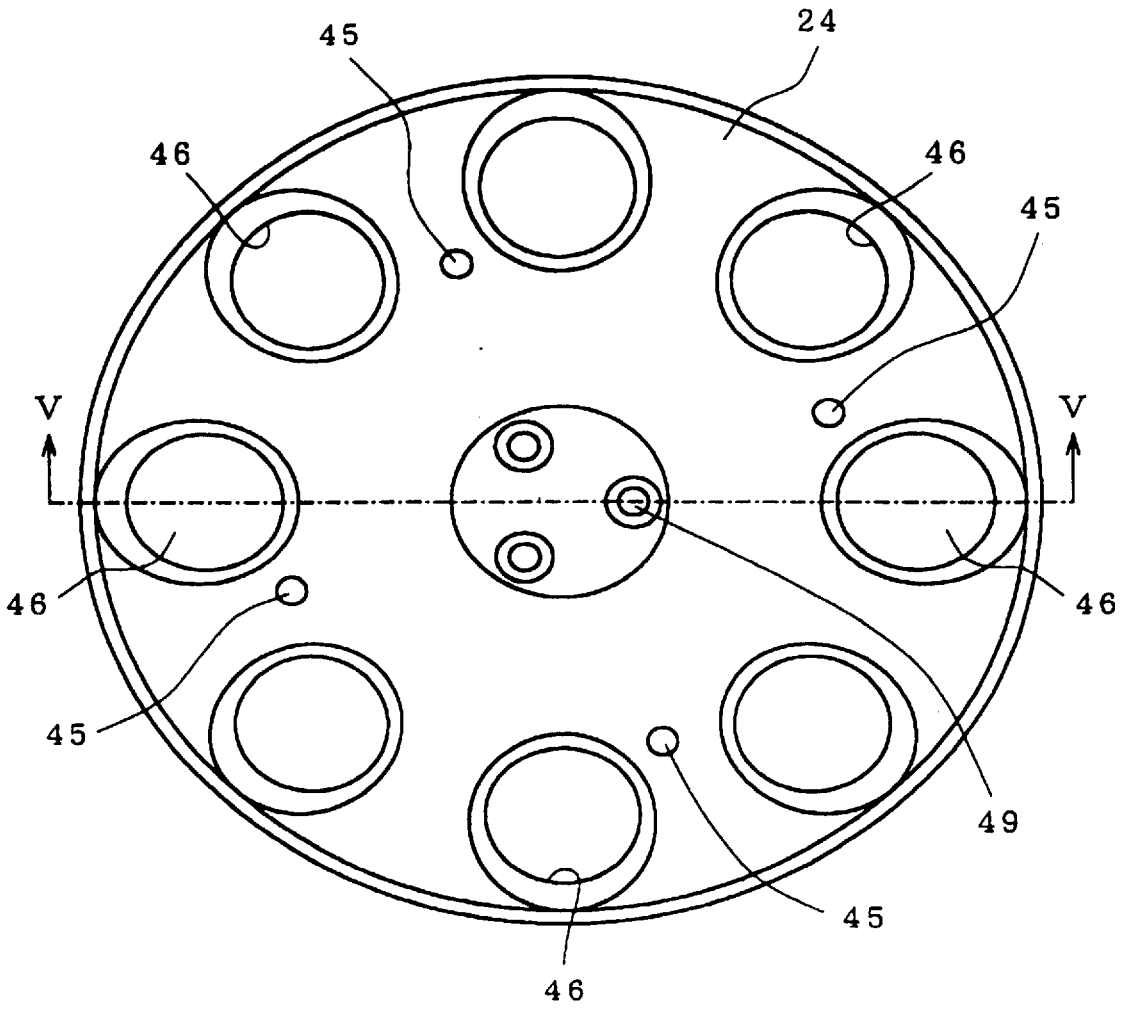
FIG. 4 is a top plan representation of a rotary disk of the coin dispenser.
Figure 5:
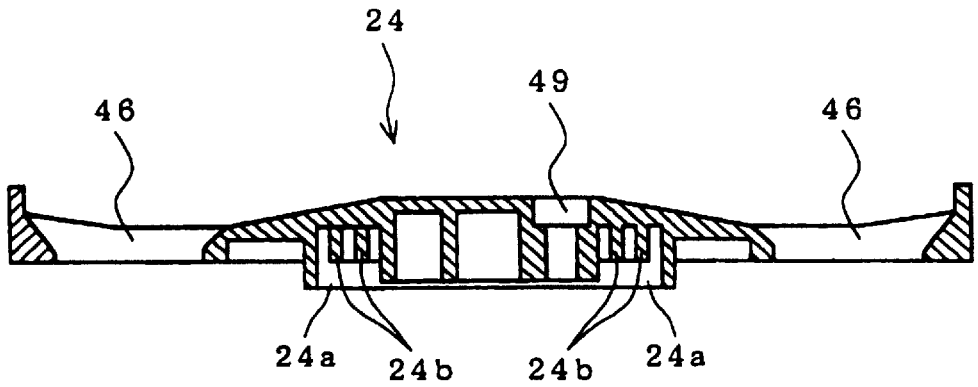
FIG. 5 is a cross-sectional side representation of the rotary disk, taken along line V—V of FIG. 4.
Figure 9:
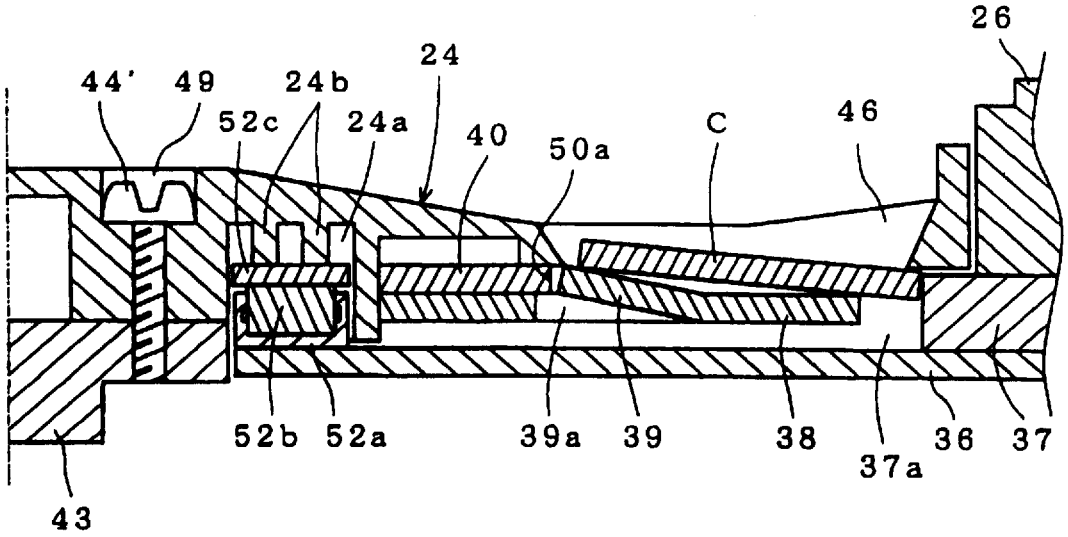
FIG. 9 is an enlarged partially cross-sectional side representation of the specific illustrative embodiment of the invention of FIG. 3 wherein a coin has entered a circular opening of the rotary disk.

FIG. 3 is a top plan representation of coin dispenser 20 of FIG. 2, partially broken away, FIG. 4 is a top plan representation of a rotary disk 24 of coin dispenser 20, and FIG. 5 is a cross-sectional side representation of rotary disk 24, taken along line V—V of FIG. 4. FIG. 9 is an enlarged partially cross-sectional side representation of FIG. 3 wherein a coin has entered one of circular openings 46 of rotary disk 24.

As shown in FIGS. 3, 4, and 9, a plurality (eight pieces, in the embodiment) of circular openings 46 are formed on rotary disk 24, each of the circular openings having a diameter that is slightly larger than a coin C. Circular openings 46 are disposed, in this specific illustrative embodiment of the invention, at uniform angular intervals along the circumference of rotary disk 24. In the vicinity of circular openings 46 of rotary disk 24, there are provided through holes 45 for inserting screws 44 therethrough, and at the center of rotary disk 24, there are provided through holes 49 for inserting screws 44' therethrough.

As shown in FIGS. 5 and 9, since the above circumference of each of circular openings 46 of rotary disk 24 is formed to have a substantially frustoconical inverted shape that widens in the upward direction, coins C can readily enter circular openings 46.

Figure 7:
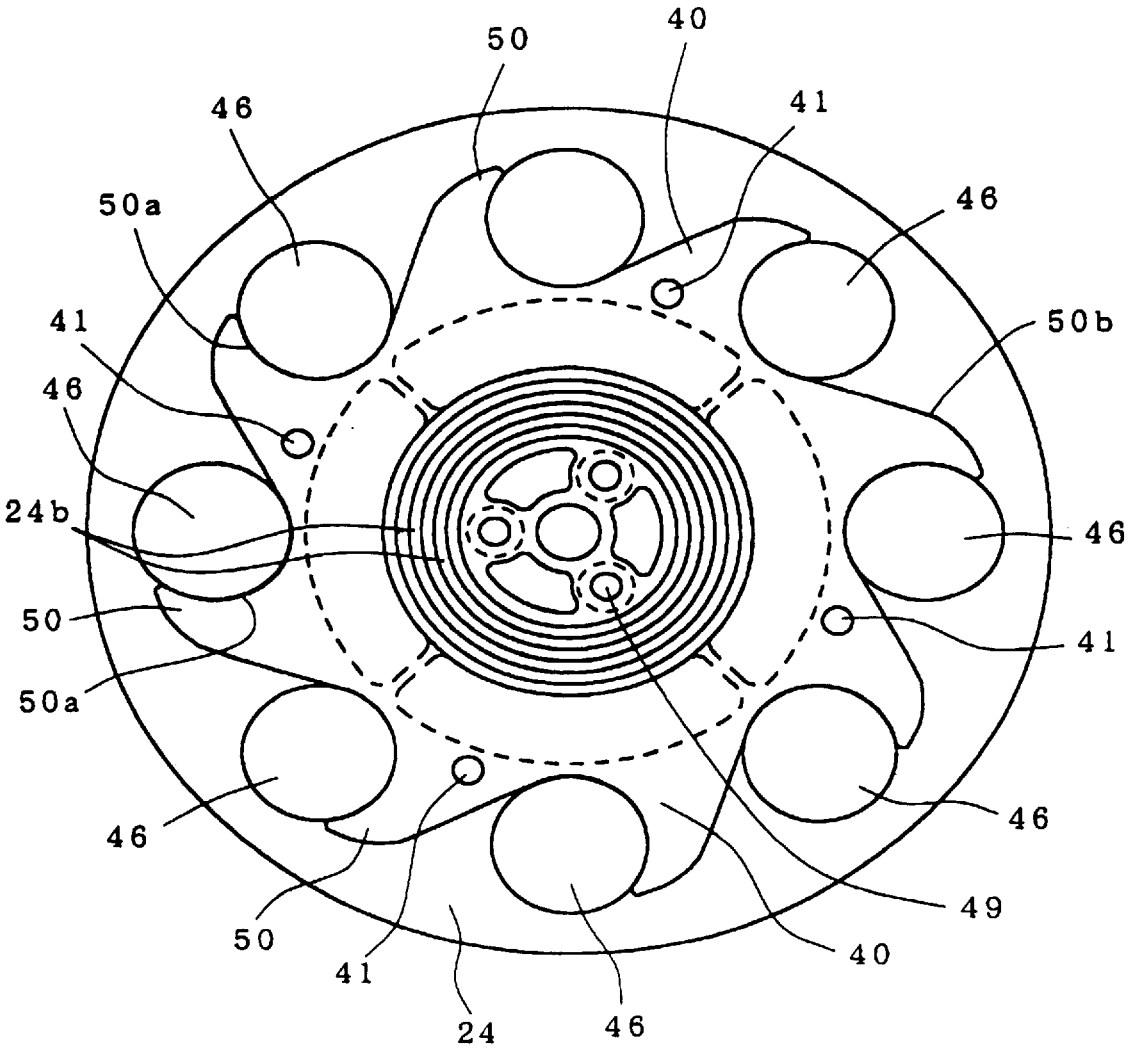
FIG. 7 is a plan representation of the underside of the rotary disk of FIG. 4 installed with the coin-feeding guide plate thereon.

On the underside of rotary disk 24, an annular installation slot 24*a* is arranged for accommodating a thrust bearing 52, shown in FIG. 2. Within the annular installation slot, two concentric annular portions 24*b*, shown in FIGS. 5, 7, and 9, are provided to project axially therefrom. In thrust bearing 52, a plurality of rollers 52*b* that rotate around an axis in the direction of radius are disposed at uniform angular intervals on an annular support disk 52*a*, whereon an annular upper disk 52*c* that is accommodated within installation slot 24*a* of rotary disk 24 is installed. Since thrust bearing 52 is accommodated within installation slots 24*a* of rotary disk 24, the thrust bearing is interposed between rotary disk 24 and baseplate 36, and receives the load of the coins in bucket 32 (not shown in these figures) that is positioned on rotary disk 24. Since upper disk 52*c* and support disk 52*a* of thrust bearing 52 are rotatable with one another by means of rollers 52*b* lying between them, rotary disk 24 will rotate smoothly at the bottom of bucket 32.

Figure 6:
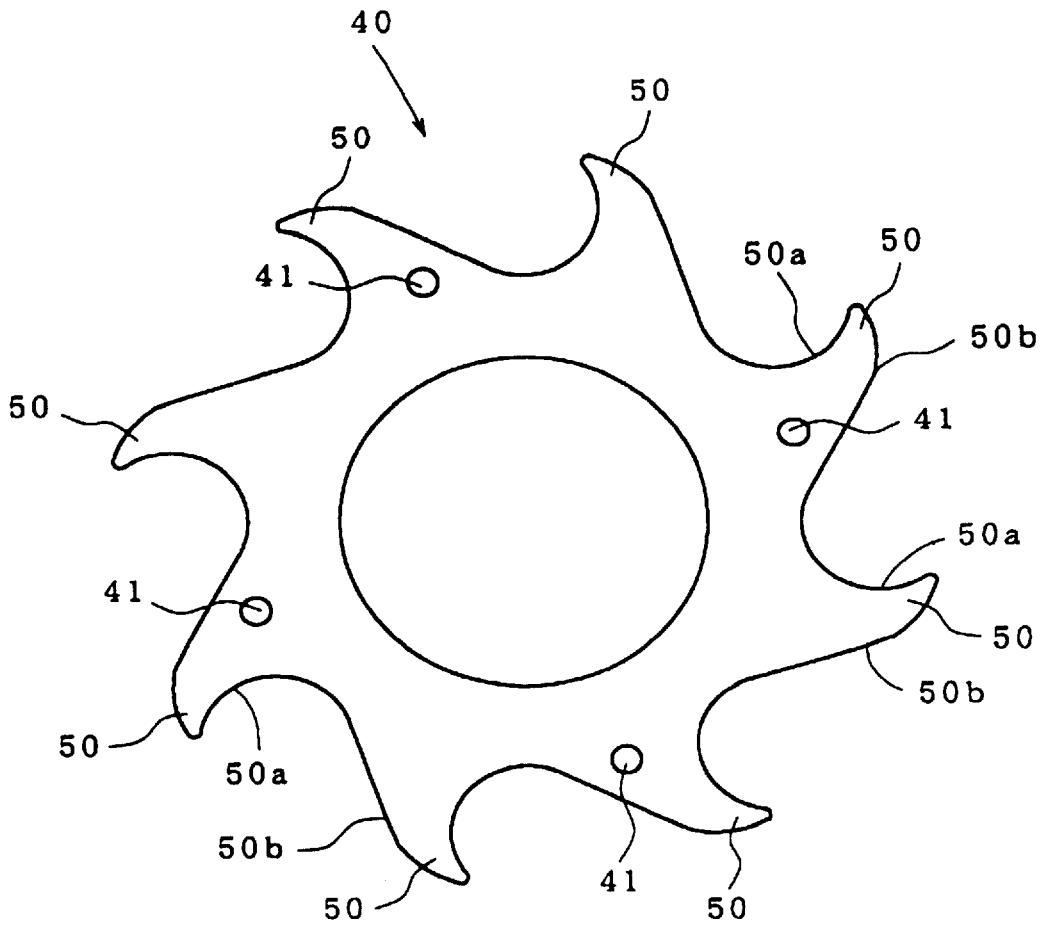
FIG. 6 is a top plan representation of a coin-feeding guide plate employed in the coin dispenser of FIG. 2.

FIG. 6 is a top plan representation of coin-feeding guide plate 40 employed in coin dispenser 20 of FIG. 2. Coin-feeding guide plate 40 is positioned at the lower side of rotary disk 24 and consists of a metallic plate of a ratchet wheel shape, as shown in FIG. 6. The coin feeding plate is provided with guide pawls 50 of the number corresponding to that of circular openings 46 of rotary disk 24. Coin-feeding guide plate 40 is provided with through holes 41 for accommodating screws 44 therethrough at positions corresponding to alternate ones of guide pawls 50. Coin-feeding guide plate 40 has substantially the same thickness as that of a coin C.

As shown in FIGS. 3 and 6, each of guide pawls 50 of the coin-feeding guide plate 40 has a shape curved counterclockwise as viewed from above. An inner edge of the curved shape thereof is formed as a coin-holding guide surface 50a, and an outer edge thereof is formed as a coin-feeding guide surface 50*b*, respectively. Each coin-holding guide surface 50*a* is formed arcuately along each of circular openings 46 of rotary disk 24. Coin-holding guide surface 50*a* of one of guide pawls 50 extends counterclockwise to become the coin-feeding guide surface of a succeeding guide pawl.

FIG. 7 is a plan representation of the underside of rotary disk 24 of FIG. 4 installed with coin-feeding guide plate 40 thereon. As shown in FIG. 7, coin-feeding guide plate 40 is positioned so that coin-holding guide surfaces 50*a* thereof fit around portions of circular openings 46 of rotary disk 24. The coin-feeding guide plate is mounted on the underside of rotary disk 24.

FIG. 8 (A) is a top plan representation of a coin receiving plate 38 of coin dispenser 20, and FIG. 8 (B) is a partially cross-sectional side representation of the coin receiving plate of FIG. 8 (A). As shown in FIG. 8 (A), coin receiving plate 38 consists of an annular metallic plate and is provided with a plurality of semicircular inclined portions 39. The number of such semicircular inclined portions is same as the number of circular openings 46 of rotary disk 24, and are arranged at uniform angular intervals along the circumference thereof As shown in FIG. 8 (B), each of inclined portions 39 is formed by bending upward the notched portion thereof to form and incline at a predetermined angle θ. Thus, slits 39*a* have arcuate shapes as viewed from above on coin receiving plate 38. Coin receiving plate 38 is provided with screw holes 51 for accommodating screws 44 therethrough at locations that correspond to through holes 41 of coin-feeding guide plate 40.

Figure 10:
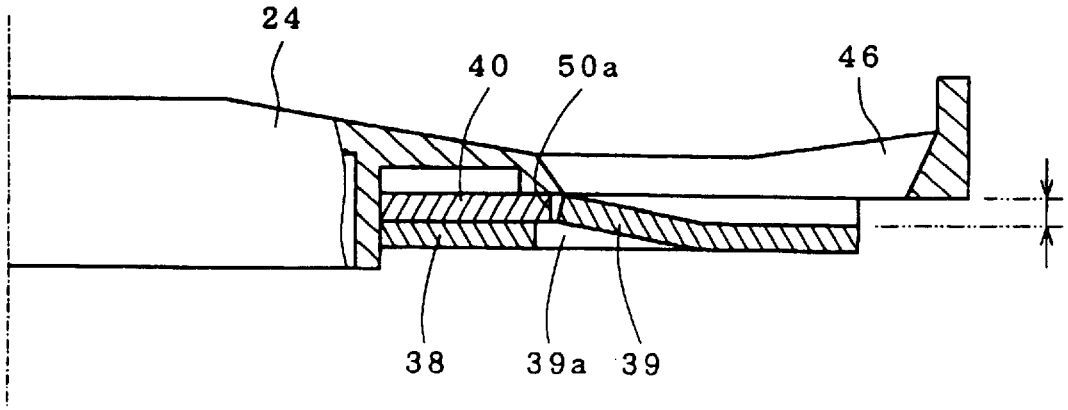
FIG. 10 is an enlarged partially cross-sectional side representation of the specific illustrative embodiment of the invention of FIG. 3 wherein a coin has not entered the circular opening of the rotary disk.
Figure 11:
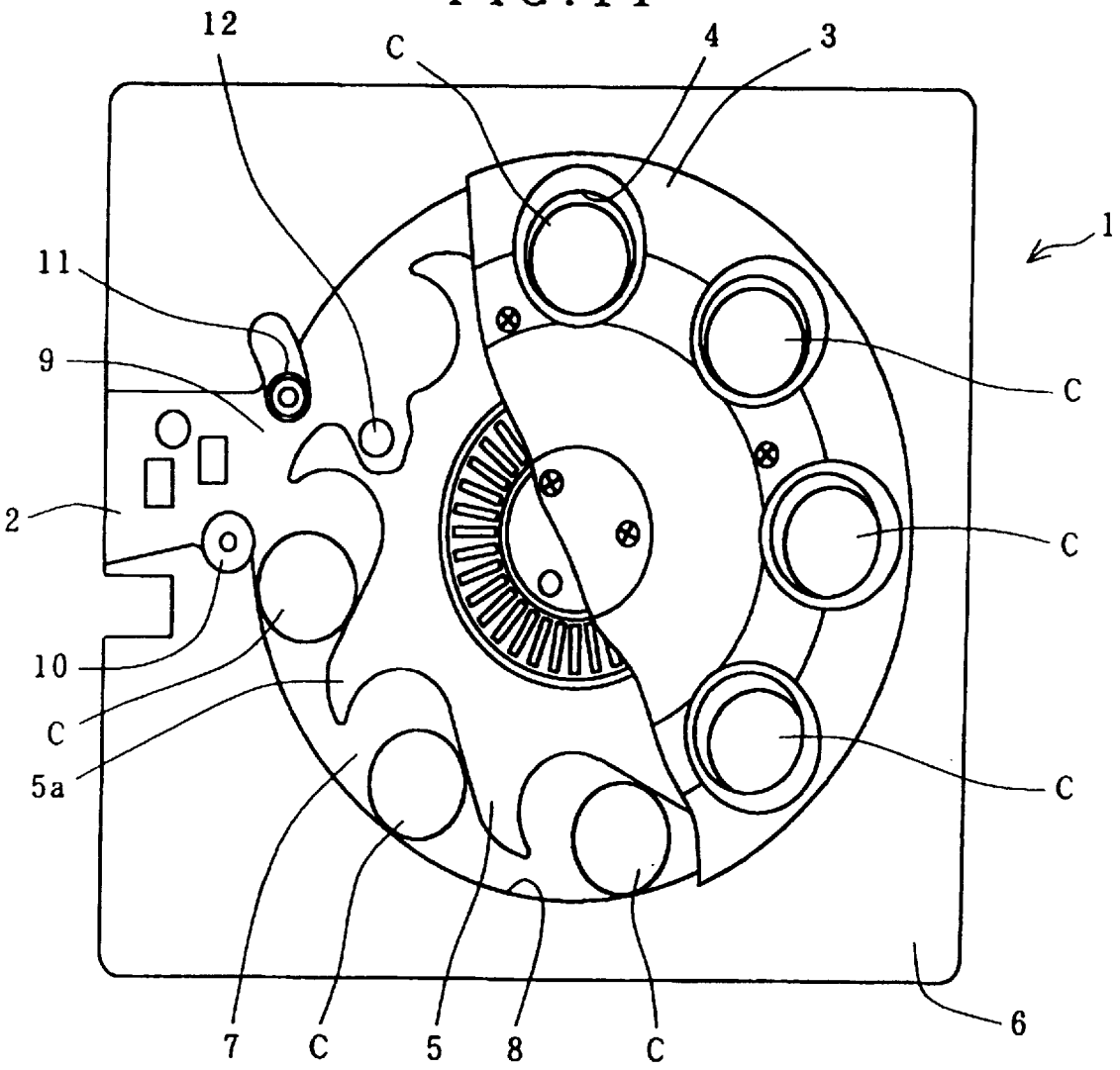
FIG. 11 is a partially top plan representation of a conventional, prior art coin dispenser.

FIG. 9 is an enlarged partially cross-sectional side representation of FIG. 3 and illustrates that a coin has entered circular opening 46 of rotary disk 24. FIG. 10 is an enlarged partially cross-sectional side representation of FIG. 3 wherein a coin has not entered circular opening 46 of rotary disk 24.

When assembling rotary disk 24, coin-feeding guide plate 40, and coin receiving plate 38, as shown in FIGS. 3, 9, and 10, they are superposed so that portions of the circumferences of circular openings 46 of rotary disk 24, coin-holding guide planes 50*a* of coin-feeding guide plate 40, and slits 39*a* of coin receiving plate 38 fit with one another. Then, they are secured to one another by screws 44 that, in this specific illustrative embodiment of the invention, are installed from above via through holes 45 of rotary disk 24, through holes 41 of coin-feeding guide plate 40, and screwing screws 44 into screw holes 51 of coin receiving plate 38.

Referring to FIGS. 2 and 3, on the surface of baseplate 36, fixed roller 54 and displaceable roller 56 are installed in the vicinity of the inlet side of coin outlet 37*b*, and function as the coin ejecting portion for ejecting the coins that have come to coin outlet 37*b*.

In detail, fixed roller 54 is rotatably disposed at a fixed position by a shaft (not shown) that extends through shaft hole 36*c* arranged on baseplate 36. Displaceable roller 56 is disposed so that its position is changeable in response to the movement of the shaft that rotatably supports the roller along elongated slot 36*d* of baseplate 36. Since coins C hit the circumferential side of displaceable roller 56 and are energetically fed to coin outlet 37*b*, the circumferential side of displaceable roller 56 is covered with an elastic member such as rubber, synthetic resin, or the like.

The shaft of displaceable roller 56 can be displaced between an outlet-closing position of an end of elongated slot 36*d* and an outlet-opening position of the other end thereof However, the shaft is ordinarily urged by the spring (not shown) toward the closed position shown in FIG. 3. In the closed position, displaceable roller 56 enters the vicinity of the outer circumferences of coin-feeding guide plate 40 and of coin receiving plate 38. In response to rotation of coin-feeding guide plate 40 and coin receiving plate 38, the coin that has come to the coin outlet 37*b* abuts on displaceable roller 56 in the closing position, and displaces displaceable roller 56 in the above direction of FIG. 3. Then, coin C is urged from the position between displaceable roller 56 and fixed roller 54 toward the outlet end of coin outlet 37*b* by the torque of displaceable roller 56 displaced in the outlet-opening position. Coin C is then energetically ejected from coin outlet 37*b*.

As shown in FIG. 2, detection of the coins ejected as described above is achieved, in this embodiment, by two coin sensors 60 and 61 that are disposed in recesses 26*a* of cover 26. A shading id 62 is additionally installed thereon. On cover 26 and baseplate 36, detection windows 26*b* and 36*e* are arranged at positions corresponding to coin sensors 60 and 61. As coin sensors 60 and 61, photosensors of the reflection or transparent type are employed. The sensors generate a detection pulse and deliver the pulse to a controller 63 each time an ejected coin passes therethrough.

Controller 63 consists of a microcomputer, and controls the operation of the gaming machine. Electric motor 42 is connected thereto via an electric motor drive circuit 64. Controller 63 delivers a drive control signal to drive circuit 64 for driving electric motor 42 in order to pay out the coins of the number corresponding to a predetermined state, or condition, of the game. Then, controller 63 drives rotary disk 24, coin-feeding guide plate 40, and coin receiving plate 38 into rotation via head 43 by operation of the motor. Thus, the coins are ejected one-by-one via coin outlet 37*b*. The ejected coins are detected by coin sensors 60 and 61, and the number of coins that are paid out is calculated by controller 63 in response to a detection signal therefrom. When the number of coins reaches the predetermined number, controller 63 inhibits driving of electric motor 42.

The following describes the operation of coin dispenser 20. If a large number of coins are present in bucket 32 of FIG. 1 when the coins of the predetermined number corresponding to the state of the game, controller 63 of FIG. 2 delivers a drive control signal to drive circuit 64 for driving electric motor 42. Rotary disk 24 is rotated clockwise in this embodiment together with coin-feeding guide plate 40 and coin receiving plate 38 via head 43 in FIG. 3. Even if a significant load is present in the axial direction of rotary disk 24 resulting from the presence of a large number of coins C, the load is supported by thrust bearing 52 and the rotary disk 24 rotates smoothly.

When coin C falls into circular opening 46 of rotary disk 24, it is supported by coin receiving plate 38. A gap is maintained between the lower side of rotary disk 24 and the upper side of coin receiving plate 38 having substantially the same thickness as a coin C by coin-feeding guide plate 40. As shown in FIG. 3, after coin C passes through circular opening 46 and is received on coin receiving plate 38, coin C is urged in the direction radially away from the center of rotary disk 24 in response to the rotation of rotary disk 24, and is concurrently carried in the direction of rotation of rotary disk 24 along the coin guide plane that is arranged at the circumference of circular opening 37*a* of outer guide plate 37. Then, since the coin is inclined by inclined portion 39 of coin receiving plate 38, as shown in FIG. 9, as the coin approaches the inlet of coin outlet 37*b*, the coin is moved toward coin-feeding guide plane 50*b* of coin-feeding guide plate 40.

Coin C then abuts against fixed roller 54 in the vicinity of the inlet of coin outlet 37*b*, and is urged by coin-feeding guide plane 50*b* of coin-feeding guide plate 40 to displace displaceable roller 56 in the opening direction. When coin C goes over displaceable roller 56 at the position where an end of guide pawl 50 abuts on coin C, coin C is energetically ejected by a torque force applied by displaceable roller 56 via coin outlet 37*b*. When the number of coins ejected as above reaches the predetermined number to be paid out, controller 63 inhibits electric motor 42, and stops ejection of the coins.

In the above-mentioned embodiment, the receipt of the coins by rotary disk 24 is improved by integration of rotary disk 24, coin-feeding guide plate 40, and coin receiving plate 38. Even though there may be present a large number of coins on rotary disk 24, the rotary disk rotates easily and is not warped, while the gap between rotary disk 24 and coin receiving plate 38 is maintained by coin-feeding guide plate 40. Therefore, jamming of the coins or the entry of foreign objects will not occur.

Furthermore, since coin receiving plate 38 has inclined portions 39 for feeding the coins entered openings 46 of rotary disk 24, in the direction away from the center of rotary disk 24, the coins are reliably moved in the direction radially away from the center of rotary disk 24 and ejected via coin outlet 37*b*.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A coin dispenser arrangement for a gaming machine, comprising:

a bucket for containing a plurality of coins used as game media in the gaming machine;

a rotary disk arranged beneath said bucket and having a plurality of circular openings arranged sequentially and circumferentially therein, each of the circular openings having a substantially circular configuration and dimensioned to receive at least one of the coins from the bucket;

drive means for driving the rotary disk rotatively;

a coin receiving plate for receiving ones of the coins that have entered the circular openings in said rotary disk from said bucket, said coin receiving plate having inclined portions thereon for inclining the ones of the coins that have entered the circular openings and moving the ones of the coins in a direction away from the center of the rotary disk, said coin receiving plate being arranged to rotate synchronously with said rotary disk;

a coin-feeding guide plate disposed beneath said rotary disk and arranged to rotate synchronously therewith and with said coin receiving plate, for guiding the ones of the coins received by said coin receiving plate in a direction substantially radially away from the center of said rotary disk, in response to the rotation thereof; and coin ejection means for ejecting the ones of the coins guided by said coin-feeding guide plate;

wherein there is maintained a gap by said coin-feeding guide plate being interposed between said rotary disk and said coin receiving plate.

2. The coin dispenser arrangement of claim 1, wherein said coin receiving plate is provided with a plurality of notches along a circumference thereof, the number of the notches being the same as the number of the circular openings in said rotary disk, each of the notches being arcuately formed and having a diameter that is slightly larger than that of each of the circular openings in said rotary disk.

3. The coin dispenser arrangement of claim 2 wherein each of the inclined portions is integrally formed with said coin receiving plate and formed by bending a portion inside of each of the notches upward to a predetermined angle θ from a surface of the coin receiving plate.

* * * * *